US005570452A

United States Patent [19]

Kuhn et al.

[11] Patent Number: 5,570,452

[45] Date of Patent: Oct. 29, 1996

[54] FLUID HEATER WITH MAIN HOUSING AND SURROUNDING AUXILIARY HOUSING DEFINING A PRESSURE RESISTANT COMPARTMENT THEREBETWEEN

[75] Inventors: Wolfgang Kuhn, Ortsteil Sende; Norbert Buchholz; Reiner Schulte, both of Bielefeld, all of Germany

[73] Assignee: Böllhoff Verfahrenstechnik GmbH & Co., KG, Bielefeld, Germany

[21] Appl. No.: 178,429

[22] Filed: Jan. 7, 1994

[30] Foreign Application Priority Data

Jan. 7, 1993 [DE] Germany ..... 43 00 163.7

[51] Int. Cl.[6] ..... H05B 3/82; F24H 1/00

[52] U.S. Cl. ..... 392/484; 392/465; 122/504

[58] Field of Search ..... 392/494, 484, 392/479, 465; 122/504; 210/175; 123/549

[56] References Cited

U.S. PATENT DOCUMENTS

| | | | |
|---|---|---|---|
| 793,118 | 6/1905 | Wright et al. . | |
| 1,797,520 | 3/1931 | Case | 392/484 |
| 2,673,919 | 3/1954 | Arvins et al. | 392/484 |
| 4,866,250 | 9/1989 | Pasbrig . | |
| 5,377,300 | 12/1994 | Collins et al. | 392/479 |

FOREIGN PATENT DOCUMENTS

| | | | |
|---|---|---|---|
| 222081 | 11/1957 | Australia | 392/484 |
| 697877 | 11/1964 | Canada | 392/484 |
| 1310051 | 11/1992 | Canada . | |
| 865334 | 2/1953 | Germany . | |
| 2156029 | 5/1973 | Germany | 392/484 |
| 3901243 | 2/1990 | Germany . | |
| 52-5036 | 1/1977 | Japan | 392/484 |
| 2116809 | 9/1983 | United Kingdom | 392/484 |
| 7900702 | 9/1979 | WIPO | 392/484 |

*Primary Examiner*—John A. Jeffery
*Attorney, Agent, or Firm*—Darby & Darby, P.C.

[57] ABSTRACT

A heater for fluids has a main housing part which is provided with flow channels for a fluid to be heated. The main housing part is surrounded by an auxiliary housing part, and the housing parts cooperate to define a compartment which is capable of containing sparks, flames and explosions. The compartment communicates with the atmosphere via one or more gaps too narrow to be penetrated by sparks and flames. The compartment further communicates with a chamber which is provided in the auxiliary housing part for switching elements. A heating foil is adhesively secured to one surface of the compartment so as to lie flat against such surface.

22 Claims, 4 Drawing Sheets

Fig.1
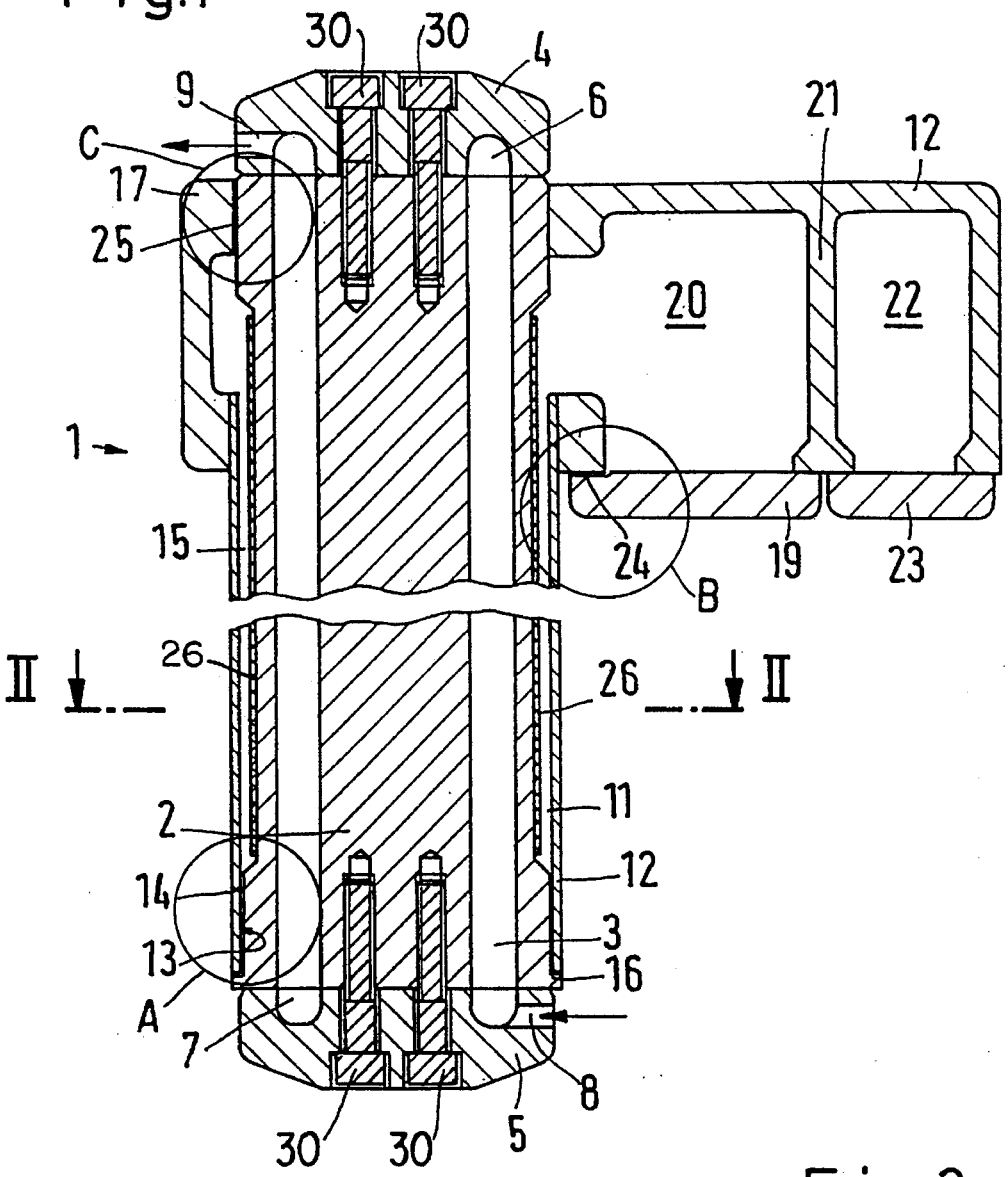
Fig.3
Fig.2
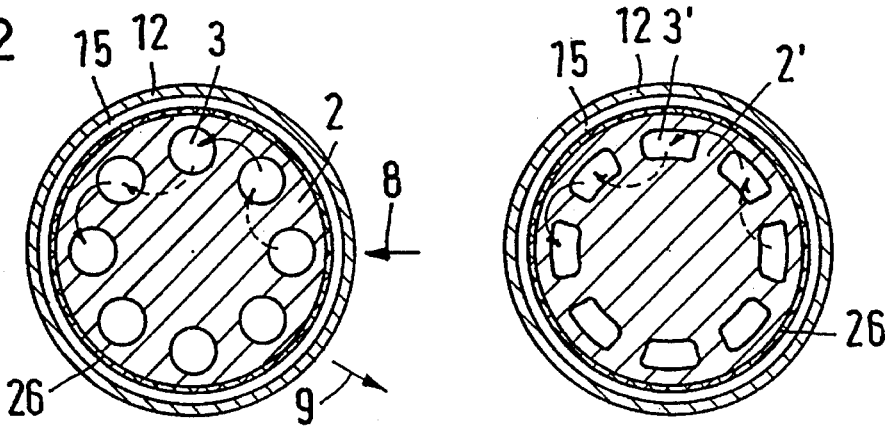

FLUID HEATER WITH MAIN HOUSING AND SURROUNDING AUXILIARY HOUSING DEFINING A PRESSURE RESISTANT COMPARTMENT THEREBETWEEN

FIELD OF THE INVENTION

The invention relates to a continuous-flow heater.

BACKGROUND OF THE INVENTION

Conventional continuous-flow heaters have a housing provided with at least one flow channel for a fluid to be heated. A panel heating element lies flush against a surface of the housing.

A heater of this type is disclosed in U.S. Pat. No. 4,866,250 where a metallic housing is circumferentially surrounded by a heating foil. The heating foil is enclosed by a thin metallic foil and, in turn, an insulating wall of foamed material or a similar insulating substance is applied to the metallic foil. The entire assembly is accommodated in an outer second housing which can be covered by insulating layer. This known continuous-flow heater serves to preheat liquid fuels.

Continuous-flow heaters are also used to heat lacquers of high viscosity. These lacquers can then be processed with reduced additions of thinners or solvents. Furthermore, the decrease in viscosity due to heating makes it possible to obtain a fine dispersion at lower spray pressures.

When such lacquers are heated, they can produce vapors capable of exploding upon ignition. Since explosions are obviously dangerous, measures must be taken to avoid explosions entirely or to prevent these from doing damage.

This safety aspect is not dealt with in U.S. Pat. No. 4,866,520. Possibly, it is assumed that danger can be avoided by embedding the heating element in other materials. However, embedment has the drawback that repair of the heater becomes very costly. In many cases, exchange or repair of the heating element cannot be accomplished without the destruction of other components.

Also known are continuous-flow heaters having cartridge heating elements or heating coils between the flow channels. The cartridge elements or heating coils are either cast into the housing or located in bores which run between the flow channels. The fundamental design of such heaters is the same as that of the heater disclosed in U.S. Pat. No. 4,866,250. The cartridge elements or heating coils are completely enclosed by the housing so that vapors from lacquers or other fluids being heated cannot travel to the cartridge elements or the heating coils to be ignited. Repair of the heater, e.g., following failure of a cartridge element or heating coil, is virtually impossible even when the cartridge elements or heating coils are located in bores. Thus, after an extended operating period, removal of the cartridge elements or heating coils from the bores becomes extremely difficult.

SUMMARY OF THE INVENTION

It is an object of the invention to provide a continuous-flow heater which is capable of being used in a potentially explosive environment.

Another object of the invention is to provide a continuous-flow heater which can be repaired with relative ease.

An additional object of the invention is to provide a method which allows a continuous-flow heater to be employed in a potentially explosive environment.

The preceding objects, as well as others which will become apparent as the description proceeds, are achieved by the invention.

One aspect of the invention resides in a continuous-flow heater. The heater comprises a housing having a first part with at least one flow channel for a fluid to be heated, and a second part having a wall which cooperates with the first part to define a pressure-resistant compartment. The first part and the wall have respective surfaces which face the compartment, and the heater further comprises a heating element for the fluid disposed at one of the surfaces. The heating element, which can be in the form of an electric panel heating element, preferably lies flush against such surface.

For ease of description, the first part will hereinafter also be referred to as the "main part" or "main housing part" while the second part will also be referred to as the "auxiliary part" or "auxiliary housing part".

In accordance with the invention, one side of the heating element is accessible to combustible vapors. The heating element is permitted to ignite these vapors which can then cause an explosion. However, the explosion is controlled. The walls bounding the pressure-resistant compartment are designed so that they can withstand the pressure generated by an explosion in the compartment and can prevent travel of the explosion to the exterior.

Furthermore, since the invention contemplates for only one side of the heating element to be in contact with the bounding walls of the pressure-resistant compartment, there is very little danger of thermal stress and the accompanying risk of damage to or destruction of the heating element. The heating element is readily accessible once the pressure-resistant compartment has been opened and can be easily repaired or replaced in the event of damage without destroying other components of the heater.

It is preferred for the heating element to be disposed at a surface of the main housing part. The heat emitted by the heating element is then able to flow directly into the main housing part and to the flow channel or channels and need not traverse large portions of the main housing part. The heating element may be arranged in the immediate vicinity of the flow channel or channels.

The pressure-resistant compartment is advantageously in communication with the atmosphere via a gap which is resistant to penetration by flame. This prevents a dangerous pressure increase in the compartment in the event of an explosion. Thus, the gap functions as a throttle valve and allows the pressure in the compartment to drop. Furthermore, an explosion in the pressure-resistant compartment cannot be transmitted to the exterior. The gap prevents flames from reaching the exterior where they can cause explosions in the atmosphere. If necessary, more than one gap can be provided. Dimensioning depends upon the contemplated use.

The pressure-resistant compartment can be at least partially filled with a non-combustible particulate material, e.g., sand. This greatly reduces the volume available for vapors or gases. Even if vapors or gases penetrate to the heating element and ignite, the quantity of such vapors or gases is small. Therefore, the force generated by explosion of the ignited vapors or gases will be small. The non-combustible particulate material can be easily introduced into and removed from the pressure-resistant compartment so that repair of the heater is not significantly affected by this material.

It is of advantage for the width of the pressure-resistant compartment, i.e., the dimension of the compartment along a direction perpendicular to the surface at which the heating element is located, to be 2 to 20 times the thickness of the heating element. The volume of the compartment is then relatively small. This again allows the quantity of explosive vapor or gas to be kept small so that the inertia or force produced by an explosion is small. Furthermore, the heating element is then spaced from the opposite surface of the pressure-resistant compartment by a distance at least equal to the thickness of the heating element.

The heating element is preferably in the form of a heating foil. A suitable heating foil is available under the name "MINCO Folienheizelemente" from Telemeter Electronic GmbH, Donauworth, Federal Republic of Germany. Such a heating foil is relatively thin and has a thickness in the range of ¼ to 3 mm. The heating foil, which can be easily adjusted to the contour of a surface even when the surface is not completely smooth, may be adhesively secured to a bounding surface of the pressure-resistant compartment. The use of a heating foil makes it possible to keep the volume of the compartment relatively small.

The auxiliary housing part may comprise a casing having a pressure-resistant switch chamber which accommodates electrical switching devices and is connected with the pressure-resistant compartment. The electrical switching devices can, for instance, include temperature regulators and limiters which generate sparks during operation, e.g., when switching on or off the current to the electrical heating element. Such a switch chamber must be provided in continuous-flow heaters which are to be used in potentially explosive environments. As a rule, the switch chamber constitutes only a relatively small portion of the heater. By connecting the switch chamber with the pressure-resistant compartment, the switch chamber is expanded in such a manner that it can also accommodate the heating element.

The switch chamber may circumscribe the main housing part over part of the length of the latter. The pressure-resistant compartment can here have an open end which likewise circumscribes the main housing part and connects the compartment with the switch chamber. This provides a large transition area between the compartment and the switch chamber. Thus, in the event of an explosion, pressure equalization between the pressure-resistant compartment and the switch chamber can take place relatively rapidly without the occurrence of dangerous local pressure increases at constrictions.

It is of advantage for the main housing part to be cylindrical and for the flow channel or channels to extend in parallelism with the longitudinal axis of the main housing part. Here, the pressure-resistant compartment and the switch chamber can each be enclosed by a cylindrical outer wall. Such outer walls have neither corners nor bends which can weaken the same. A cylindrical configuration is well-suited for nonproblematic absorption of pressures which may arise.

The heating element can be disposed in a depression of the main housing part. At least two advantages are achieved by the depression. On the one hand, space for the pressure-resistant compartment is created without increasing the outer dimensions of the heater. On the other hand, the heating element can be located nearer the flow channel or channels so that heat transfer is improved.

The wall of the auxiliary housing part is preferably designed so that it can be slipped over the main housing part from one end of the latter to a position in which the wall covers the depression over at least part of the length of the depression. Such wall then constitutes the outer wall of the pressure-resistant compartment. The wall may be circumferentially complete thereby eliminating the need for axially extending connections. This allows relatively high pressure resistance to be obtained in a simple manner. With proper dimensioning, the flame-resistant gaps are established automatically upon sliding of the wall onto the main housing part.

It is preferred for the switch chamber casing to be designed in such a manner that it can be slid onto the main housing part from one end of the same to a position in which the casing at least partially covers the wall. Like the wall, the casing can be circumferentially complete so that is need not be closed along an axially or longitudinally extending segment thereof. Again, this results in a relatively high pressure resistance. With appropriate dimensioning, gaps resistant to penetration by flame can be formed automatically when the wall and switch chamber casing are slipped onto the main housing part.

The wall and the casing may be integral with one another and, in particular, may be constituted by a casting. This enables assembly to be simplified. Thus, only one component need be pushed over the main housing part in order to provide the pressure-resistant compartment and the switch chamber casing.

In addition to the switch chamber, the auxiliary housing part can contain a chamber of increased safety. By way of example, the safety chamber can serve to accommodate bulbs or other indicating elements and to conduct electrical cables.

The safety chamber can be situated radially outward of the switch chamber. Alternatively, the switch chamber and safety chamber can be arranged so that each extends around a different portion of the circumference of the main housing part. It is also possible for the switch chamber and safety chamber to be disposed at opposite longitudinal ends of the main housing part. The last two arrangements, in particular, are very space-saving.

The main housing part is preferably composed of stainless steel. This material makes it possible to operate with water-based lacquers. The use of a panel heating element is especially advantageous for a stainless steel housing or housing part because it is difficult to equip such a housing or housing part with heating coils or cartridge heaters.

BRIEF DESCRIPTION OF THE DRAWINGS

Other features and advantages of the invention will become apparent from the following detailed description of preferred embodiments when read in conjunction with the accompanying drawings.

FIG. 1 is a longitudinal sectional view of one embodiment of a continuous-flow heater in accordance with the invention;

FIG. 2 is a sectional view in the direction of the arrows II—II of FIG. 1;

FIG. 3 is a view similar to FIG. 2 of another embodiment of a continuous-flow heater according to the invention;

DESCRIPTION OF PREFERRED EMBODIMENTS

Figure 4:
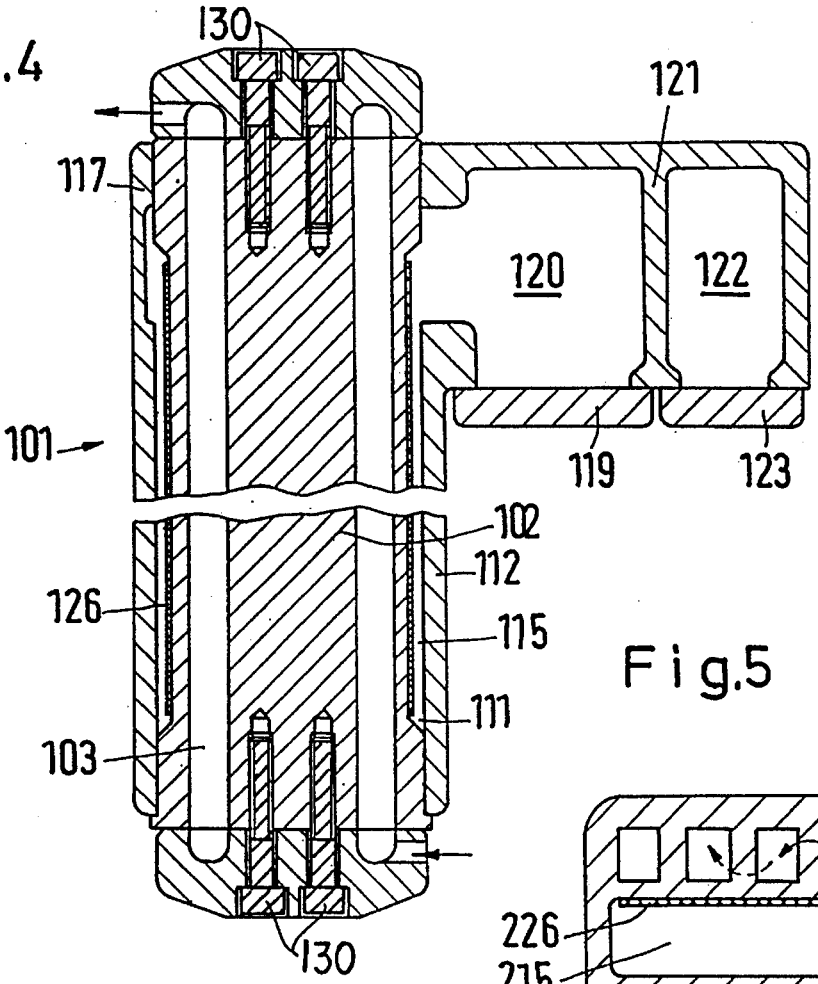
FIG. 4 is a view similar to FIG. 1 of an additional embodiment of a continuous-flow heater in accordance with the invention.

In FIG. 1, the reference numeral 1 generally identifies a continuous-flow heater in accordance with the invention. The heater 1 has a substantially cylindrical first or main housing part 2 having flow channels 3 which extend parallel to the longitudinal axis of the main housing part 2. The main housing part 2 includes an upper cover 4 provided with grooves 6 and a lower cover 5 provided with grooves 7. Covers 4, 5 are connected to the main housing part 2 by threaded fasteners 30. The grooves 6 and 7 connect the flow channels 3 to one another. The arrangement is such that fluid admitted into the main housing part 2 via an inlet 8 flows sequentially through the flow channels 3 to an outlet 9 of the main housing part 2. The direction of flow of the fluid changes from one flow channel 3 to another so that the fluid flows alternately upward and downward in the main housing part 2. When the main housing part 2 has an uneven number of flow channels 3, the inlet 8 and outlet 9 are located at opposite ends of the main housing part 2. On the other hand, the inlet 8 and outlet 9 are disposed at the same end of the main housing part 2 when the latter contains an even number of flow channels 3. By way of example, the inlet 8 and outlet 9 can then both be provided in the lower cover 5.

The main housing part 2 is here assumed to be composed of stainless steel.

The flow channels 3 have a circular cross section as illustrated in FIG. 2. However, other cross-sectional configurations are possible. Thus, FIG. 3 shows a main housing part 2' with flow channels 3' of approximately trapezoidal cross section.

Referring back to FIG. 1, the outer periphery of the main housing part 2 is provided with a depression 11 which extends along part of the length of the main housing part 2. The depression 11 is partly covered by a wall 12 belonging to a second or auxiliary housing part. The wall 12 has the form of a hollow cylinder and is slidably mounted on the main housing part 2. Thus, the wall 12 is positioned on the main housing part 2 by slipping it over one end of the main housing part 2. The wall 12 cooperates with the main housing part 2 to define a pressure-resistant compartment 15.

The main housing part 2 has an outer peripheral surface portion 13 in the region of the lower cover 5. The outer diameter of the main housing part 2 at the peripheral surface portion 13 equals the inner diameter of the compartment wall 12, and the peripheral surface portion 13 serves as a guide for the compartment wall 12. The compartment wall 12 abuts a shoulder 16 at the lower end of the main housing part 2.

Figure 11:
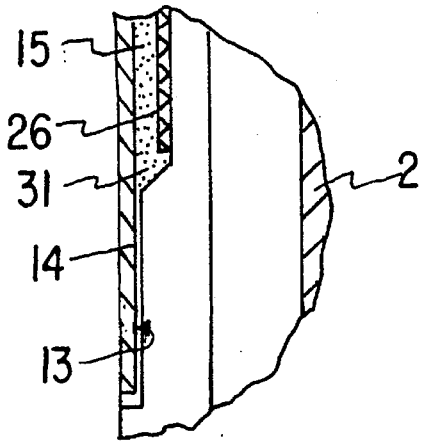
FIG. 11 is an enlarged view of circle detail A of FIG. 1.

A gap 14 resistant to penetration by flame, i.e., a narrow gap, is located between the compartment wall 12 and the peripheral surface portion 13 (see FIGS. 1 and 11). The gap 14 permits gases to flow from the pressure-resistant compartment 15 into the atmosphere. However, the gap 14 is so long and narrow that flames are unable to pass through the gap 14. The gap 14 has a throttling effect and causes the pressure of gases to drop as they travel towards the exterior.

Figure 12:
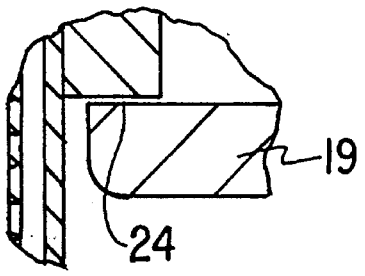
FIG. 12 is an enlarged view of circle detail B of FIG. 1.

The auxiliary housing part further includes a casing 17 which circumscribes the main housing part 2 in the vicinity of the upper cover 4. The casing 17 has a radially outward projecting portion which contains a switch chamber 20 and a chamber 22 of increased safety separated from the switch chamber 20 by a dividing wall 21. The switch chamber 20 is closed by a cover 19 while the safety chamber 22 is closed by a cover 23. A gap 24 resistant to penetration by flame is disposed between the cover 19 and the main part of the casing 17 (see FIGS. 1 and 12). The switch chamber 20 accommodates electrical switching devices such as temperature regulators or the like which can generate sparks during switching. On the other hand, the safety chamber 22 accommodates bulbs or similar indicating instruments as well as cable guides.

The pressure-resistant compartment 15 and, if necessary, the switch chamber 20, can be filled with sand 31 or a comparable non-combustible particulate material (see FIG. 11).

Figure 13:
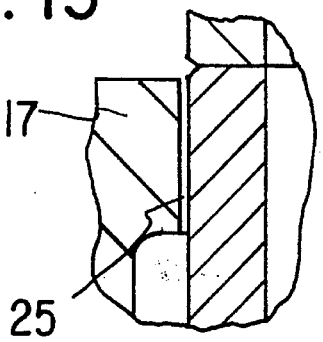
FIG. 13 is an enlarged view of circle detail C of FIG. 1.

The casing 17 and switch chamber 20 circumscribe the compartment wall 12 as well as the main housing part 2. Similarly to the compartment wall 12, the casing 17 is positioned on the main housing part 2 by pushing the casing 17 over one end of the main housing part 2. A gap 25 resistant to penetration by flame exists between the casing 17 and the main housing part 2 in the region of the upper cover 4 (see FIGS. 1 and 13).

A panel heater or heating element of relatively small thickness is located in the depression 11 and is adhesively secured to the main housing part 2. The panel heater is here assumed to be in the form of an electrical heating foil 26. Due to the fact that the heating foil 26 is situated in the depression 11, the distance between the heating foil 26 and the flow channels 3 is relatively small. As soon as current flows through the heating foil 26, the heating foil 26 generates heat. This heat is transferred to the main housing part 2 and then travels to the fluid flowing through the flow channels 3.

Due to the structural arrangement, the heating foil 26 is not inherently safe. Thus, the heating foil 26 can become so hot that it can ignite a combustible gaseous mixture. When processing liquid lacquers, vapors are readily produced. In combination with the air of the surroundings, these vapors can form a combustible mixture which, upon ignition, can flare up or even explode. Such a mixture can penetrate to the heating foil 26. However, inasmuch as the heating foil 26 is disposed in the pressure-resistant compartment 15, explosions occurring in the vicinity of the heating foil 26 do not affect the exterior. Pressure resulting from an explosion in the pressure-resistant compartment 15 can be reduced via the flame-resistant gaps 14,24,25 without the danger of flames travelling to the outside and igniting a combustible mixture there.

The pressure-resistant compartment 15 has a relatively small width, and hence a relatively small volume. The width of the pressure-resistant compartment 15 is about 2 to 20 times the thickness of the heating foil 26. On the one hand, this insures that not too large a quantity of a combustible mixture can penetrate to the heating foil 26. As the quantity of an explosive mixture is reduced, the forces arising during an explosion decrease. On the other hand, a compartment width of about 2 to 20 times the heating foil thickness insures that only side of the heating foil 26 contacts a bounding surface of the pressure-resistant compartment 15. The opposite side is free so that differential thermal expansion of different housing components does not generate stresses in the heating foil 26 which could damage or even destroy the latter.

Access to the heating foil 26 can be obtained by simply pulling the casing 17 and the compartment wall 12 off the main housing part 2. The heating foil 26 can then be repaired or replaced.

The pressure-resistant compartment 15 has an annular open upper end which circumscribes the main housing part 2. The compartment 15 and the switch chamber 20 communicate with one another via the entire area of the open upper end of the compartment 15. Since the compartment 15 and the switch chamber 20 are thus in communication over a relatively large area, relatively good gas exchange can take place between the switch chamber 20 and the pressure-resistant compartment 15. Accordingly, if an explosion occurs in one or the other of the compartment 15 and the chamber 20, the pressure can equalize rapidly.

In FIG. 4, the same reference numerals as in FIG. 1 plus 100 are used to identify corresponding components.

The continuous-flow heater 101 of FIG. 4 differs from the heater 1 of FIG. 1 in that the compartment wall 112 is integral with the casing 117. Thus, the wall 112 and casing 117 are constituted by a casting which is slidably mounted on the main housing part 102. The casting 112,117 encloses the compartment 115 as the casting 112,117 is slipped onto the main housing part 102. Except for the integral construction of the wall 112 and casing 117, the heater 101 is identical to the heater 1 of FIG. 1.

Figure 5:
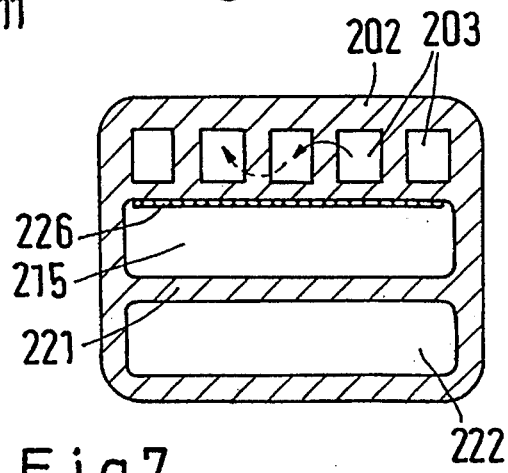
FIG. 5 is a view similar to FIG. 2 of a further embodiment of a continuous-flow heater according to the invention.

With reference to FIG. 5, the same reference numerals as in FIG. 1 plus 200 are used to identify corresponding components.

The main housing part 202 of FIG. 5 is substantially square or rectangular rather than circular. The flow channels 203, which are likewise square or rectangular instead of circular, are arranged in a row.

The dividing wall 221, which partially constitutes the auxiliary housing part, cooperates with the main housing part 202 to define the pressure-resistant compartment 215. The latter is located approximately in the middle of the housing made up of the main housing part 202 and the auxiliary housing part. The heating foil 226 is disposed in the compartment 215 and is adhesively secured to a bounding wall or surface thereof. The safety chamber 222 is situated on the side of the compartment 215 remote from the flow channels 203 and is separated from the compartment 215 by the dividing wall 221.

Figure 6:
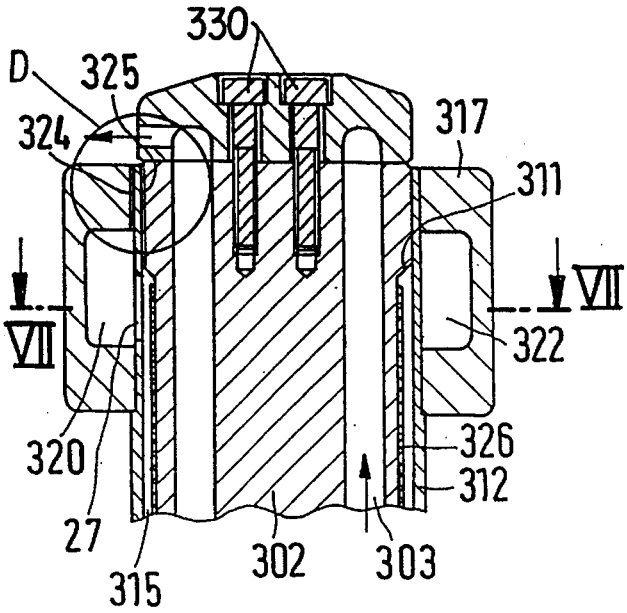
FIG. 6 is a fragmentary longitudinal sectional view of yet another embodiment of a continuous-flow heater in accordance with the invention.
Figure 7:
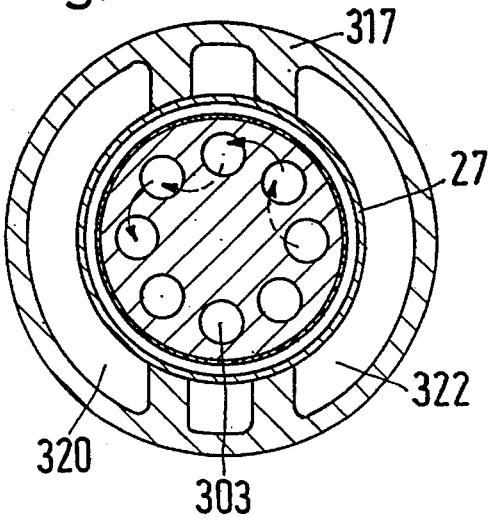
FIG. 7 is a sectional view in the direction of the arrows VII—VII of FIG. 6.

Turning to FIGS. 6 and 7, the same reference numerals as in FIG. 1 plus 300 are used to identify corresponding components.

Figure 14:
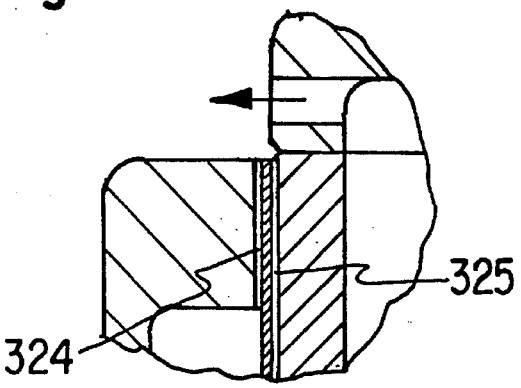
FIG. 14 is an enlarged view of circle detail D of FIG. 6.

In contrast to FIGS. 1 and 4, the switch chamber 320 of FIGS. 6 and 7 does not circumscribe the main housing part 302. Instead, the switch chamber 320 occupies an area around a first half of the circumference of the main housing part 302 while the safety chamber 322 occupies an area around the second half of such circumference. The pressure-resistant compartment 315 is enclosed by the compartment 312 which here extends over the entire length of the main housing part 302. The wall 312 is provided with an opening or window 27 via which the compartment 315 communicates with the switch chamber 320. The two flame-resistant gaps 324 and 325 allow release of the pressure generated by explosions in the compartment 315 and the switch chamber 320 (see FIGS. 6 and 14). However, the gaps 324 and 325 prevent the escape of flames and sparks from the pressure-resistant compartment 315 and the switch chamber 320.

The main housing part 302 of FIGS. 6 and 7 is identical, or virtually identical, to the main housing part 2 of FIG. 1.

Figure 8:
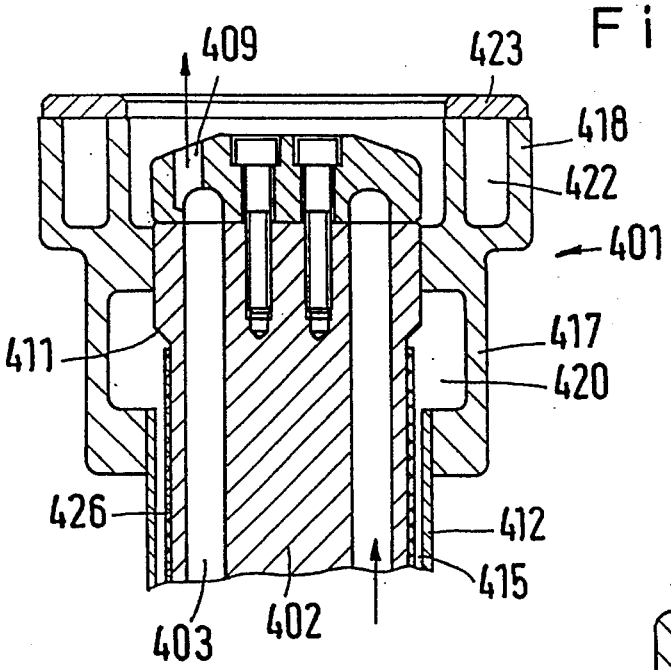
FIG. 8 is a view similar to FIG. 6 of still a further embodiment of a continuous-flow heater according to the invention.

Referring to FIG. 8, the same reference numerals as in FIG. 1 plus 400 are used to identify corresponding components.

The main housing part 402 and compartment wall, which together define the pressure-resistant compartment 415, have the same design as the main housing part 2 and compartment wall 12 of FIG. 1. However, the casing 417 differs from the casing 17. Thus, the casing 417, which accommodates the switch chamber 420, has an axial extension 418 containing the chamber 422 of increased safety. Both the switch chamber 420 and the safety chamber 422 are annular and circumscribe the main housing part 402. The safety chamber 422 is closed by a cover 423. Since the extension 418 prevents radial discharge of fluid from the main housing part 402, the outlet 409 is substantially axial.

Figure 9:
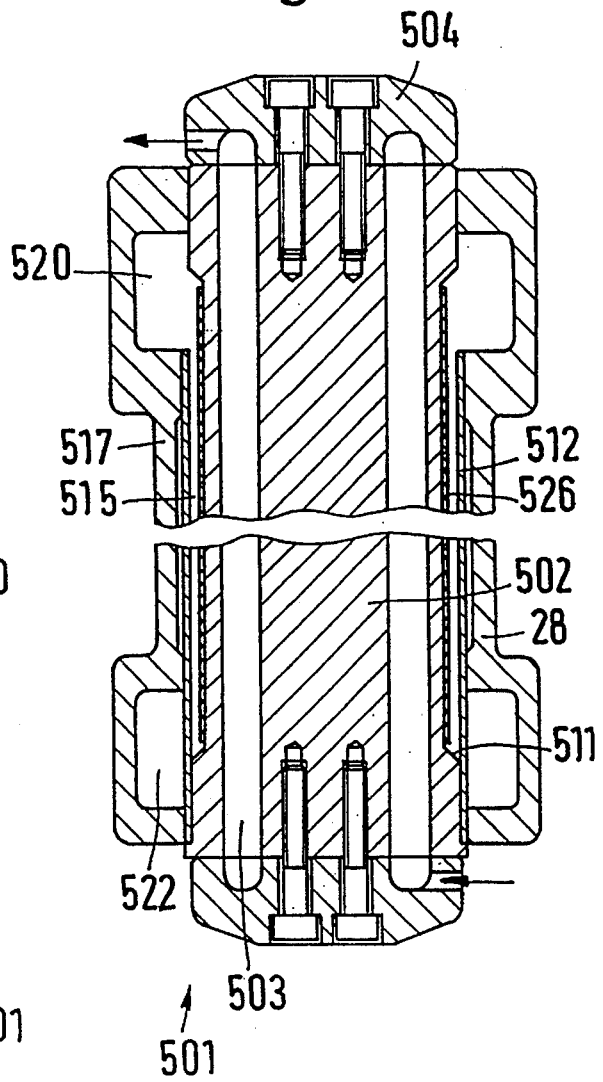
FIG. 9 is a view similar to FIG. 1 of an additional embodiment of a continuous-flow heater in accordance with the invention.

In FIG. 9, the same reference numerals as in FIG. 1 plus 500 are used to identify corresponding components.

The main housing part 502 and compartment wall 512 are identical to the main housing part 2 and compartment wall 12 of FIG. 1. In contrast to FIG. 1, the casing 517 contains only the switch chamber 520. The casing 517 is located at one end of the main housing part 412 and a second casing is disposed at the other end of the main housing part 502. The second casing accommodates the chamber 522 of increased safety. The second casing is connected to the casing 517 by an external wall 28. The external wall 28, over most of its length, has a small spacing from the compartment wall 512, which facilitates sliding of the auxiliary housing part including the chambers 520,522 over the compartment wall 512. The switch chamber 520 as well as the safety chamber 522 are again annular and circumscribe the main housing part 502.

Figure 10:
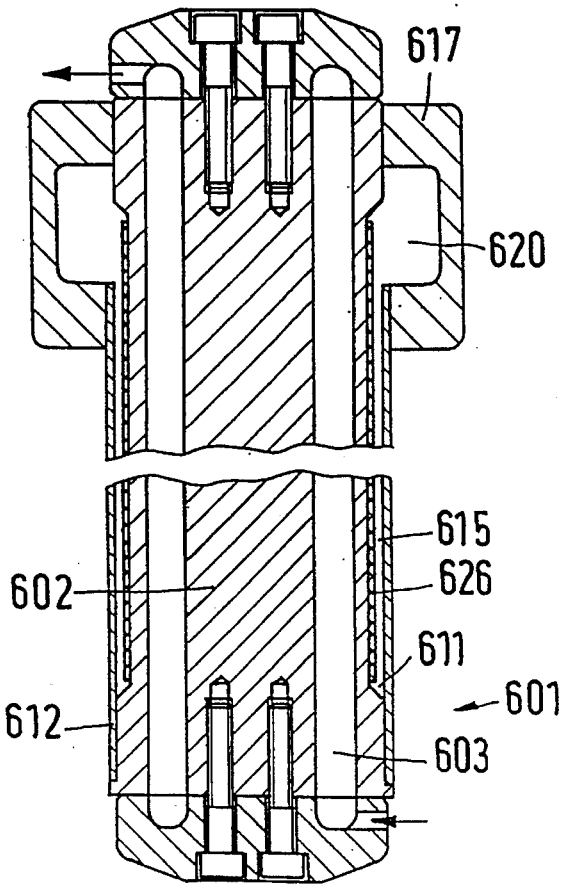
FIG. 10 is a view similar to FIG. 1 of one more embodiment of a continuous-flow heater according to the invention.

Turning to FIG. 10, the same reference numerals as in FIG. 1 plus 600 are used to identify corresponding components.

The continuous-flow heater 601 of FIG. 10 lacks a chamber of increased safety but is otherwise virtually identical to the heater 501 of FIG. 9. The pressure-resistant compartment 615 once more has an annular open upper end, and the switch chamber 620 communicates with the compartment 615 over the entire area of such end. The heating foil 626 is located in the compartment 615 and is adhesively secured to the outer peripheral surface of the main housing part 602 in the depression 611. The heating foil lies flat against this outer peripheral surface which bounds the compartment 615 on one side.

Various modifications are possible within the meaning and range of equivalence of the appended claims.

We claim:

1. A continuous-flow heater, comprising a housing having a first part with at least one flow channel for a fluid to be heated, said first part having an outer surface, and a second part disposed adjacent to said first part, said second part having a wall including an inner surface which cooperates with said outer surface of said first part to define an encapsulated flame-proof, pressure-resistant compartment, said compartment communicating with the atmosphere, a non-combustible substance being disposed in said compartment; and a heating element, for the fluid, disposed substantially flush against one of said surfaces.

2. The heater of claim 1, wherein said element comprises an electric heating foil.

3. The heater of claim 1, wherein said one surface is said surface of said first part.

4. The heater of claim 1 wherein said compartment is connected with the atmosphere by at least one gap resistant to penetration by flames.

5. The heater of claim 1, wherein said substance is particulate.

6. The heater of claim 1, wherein said element has a predetermined thickness and said compartment has a width of at least 2 times said predetermined thickness.

7. The heater of claim 1, wherein said element has a predetermined thickness and said compartment has a width of at most 20 times said predetermined thickness.

8. The heater of claim 1, wherein said element comprises a heating foil.

9. The heater of claim 1, wherein said second part has a pressure-resistant chamber for a switch, said chamber communicating with said compartment.

10. The heater of claim 9, wherein said chamber circumscribes said first part, said compartment having an open end which circumscribes said first part and connects said compartment with said chamber.

11. The heater of claim 1, wherein said first part is substantially cylindrical and has a longitudinal axis, said channel extending in substantial parallelism with said axis.

12. The heater of claim 1, wherein said first part is provided with a depression and said element is located in said depression.

13. The heater of claim 12, wherein said wall is slidably mounted on said first part and at least partially covers said depression.

14. The heater of claim 13, wherein said second part further comprises a casing having a chamber for a switch, said casing being slidably mounted on said first part and at least partially covering said wall.

15. The heater of claim 1, wherein said second part comprises a casing having a chamber for a switch, said casing being integral with said wall.

16. The heater of claim 15, wherein said second part is a casting.

17. The heater of claim 1, wherein said second part has a first chamber comprising a switch and a second chamber for another component.

18. The heater of claim 17, wherein said second chamber is located radially outward of said first chamber.

19. The heater of claim 17, wherein each of said chambers partly surrounds said first part.

20. The heater of claim 1, wherein said first part has opposite ends, said second part comprising a first casing having a first chamber for a switch and a second casing having a second chamber for another component, said casings being located at different ones of said ends.

21. The heater of claim 1, wherein said first part comprises stainless steel.

22. A continuous-flow heater, comprising a housing having a first part with at least one flow channel for a fluid to be heated, said first part having an outer surface, and a second part disposed adjacent to said first part, said second part having a wall including an inner surface which cooperates with said outer surface of said first part to define an encapsulated flame-proof, pressure-resistant compartment, said compartment communicating with the atmosphere; and a heating element, for the fluid, disposed substantially flush against one of said surfaces, wherein said first part is provided with a depression and said heating element is located in said depression, said wall being slidably mounted on said first part and at least partially covering said depression.

* * * * *